US006416132B1

(12) United States Patent
Norton et al.

(10) Patent No.: US 6,416,132 B1
(45) Date of Patent: Jul. 9, 2002

(54) SWING SEAT

(75) Inventors: John J. Norton, Stow; Thomas E. Fish, Wickliffe, both of OH (US)

(73) Assignee: The Little Tikes Company, Hudson, OH (US)

( * ) Notice: Subject to any disclaimer, the term of this patent is extended or adjusted under 35 U.S.C. 154(b) by 0 days.

(21) Appl. No.: 09/742,251

(22) Filed: Dec. 20, 2000

(51) Int. Cl.[7] ..... A47D 1/10
(52) U.S. Cl. ..... 297/467; 297/484; 297/280
(58) Field of Search ..... 297/467, 484, 297/277–281

(56) References Cited

U.S. PATENT DOCUMENTS 3,065,028 A * 11/1962 Irion ..... 297/467
5,238,291 A 8/1993 Alionis ..... 297/118
5,320,416 A * 6/1994 Kornberg ..... 297/467
5,334,099 A * 8/1994 Marra et al. ..... 297/467
5,413,399 A 5/1995 Myers et al. ..... 297/118
5,833,311 A * 11/1998 Friedrich et al. ..... 297/467
6,095,614 A * 8/2000 Canna et al. ..... 297/467

* cited by examiner

*Primary Examiner*—Peter R. Brown
(74) *Attorney, Agent, or Firm*—Piper Rudnick

(57) ABSTRACT

A swing seat comprising a chair having a region for the placement of a child and a bar rotatably coupled to the chair at one end thereof. The opposite end of the bar is capable of engaging the bottom of the chair. When secured to the bottom of the chair, the bar is at such a position so as to allow a person to remove the child from the chair. A plurality of straps are removably coupled to the bar and are used for securing the child in the chair. At least one support rope is coupled to the chair, allowing the swing seat to be suspended above the ground or other surface.

12 Claims, 5 Drawing Sheets

SWING SEAT

TECHNICAL FIELD

This invention relates generally to swing seats. More particularly, this invention relates to a swing seat for a child that includes a bar that both secures the child in the seat and is capable of being moved to a second position in order to easily place the child in the seat or remove the child from the seat.

BACKGROUND OF THE INVENTION

Children's swing seats are well known in the toy industry. Many such seats include a standard children's chair and a T-bar. The T-bar couples at least one end to the front portion of the seat and is used to secure the child in place after he or she is placed into the seat. Although such arrangements are moderately effective, they also have a number of drawbacks. For example, some swing seats have a T-bar that is fixedly connected to the chair. This arrangement can result in increased difficulty in both placing the child in the seat and removing the child from the seat. Other seats have a T-bar that can be slideably or rotatably moved relative to the rest of the seat, allowing the T-bar to be moved away from the front of the seat when a child is being positioned or removed therefrom. A major disadvantage of this arrangement, however, is that allowing the T-bar to swing freely can result in a large amount of damage to the T-bar, especially if it is allowed to swing freely below the seat when a child is not secured therein. Furthermore, having such a movable T-bar can cause additional difficulty in storing the swing seat when not in use. For these reasons, it is desirable to have a swing seat that includes a movable component that both is movable relative to the seat and also capable of being fixed in a position away from the seat when a child is being placed in the chair or removed therefrom.

SUMMARY OF THE INVENTION

This invention provides for a children's swing seat comprising a chair having a region for the placement of the child. A bar is rotatably coupled at one end thereof to the chair. The bar is generally in the form of a "T" shape and includes a longitudinal portion, which is rotatably coupled to the chair, and a transverse portion which is substantially perpendicular to the longitudinal portion. A plurality of straps that are coupled to the chair are capable of engaging the transverse portion of the bar. When engaged to each other, the straps and bar secure the child in place. When the bar is uncoupled from the straps, the bar is capable of rotating away from the front portion of the seat and proximate to the bottom portion of the seat, allowing the person to quickly and easily place a child in the seat or remove the child therefrom.

It is therefore an advantage of the present invention to provide a children's swing seat with a movable T-bar which is capable of being fixed in a position away from the front portion of the seat.

It is another advantage of the present invention to provide a swing seat that includes a T-bar that is easily rotatable into and out of the engagement with straps for securing a child in place and a lower portion of the seat to prevent unnecessary movement of the T-bar while the child is being removed from the seat or placed in the seat.

Further advantages and features of the present invention will be apparent from the following specification and claims considered in conjunction with the accompanying drawings illustrating preferred embodiments of the present invention.

DETAILED DESCRIPTION OF THE INVENTION

Figure 1:
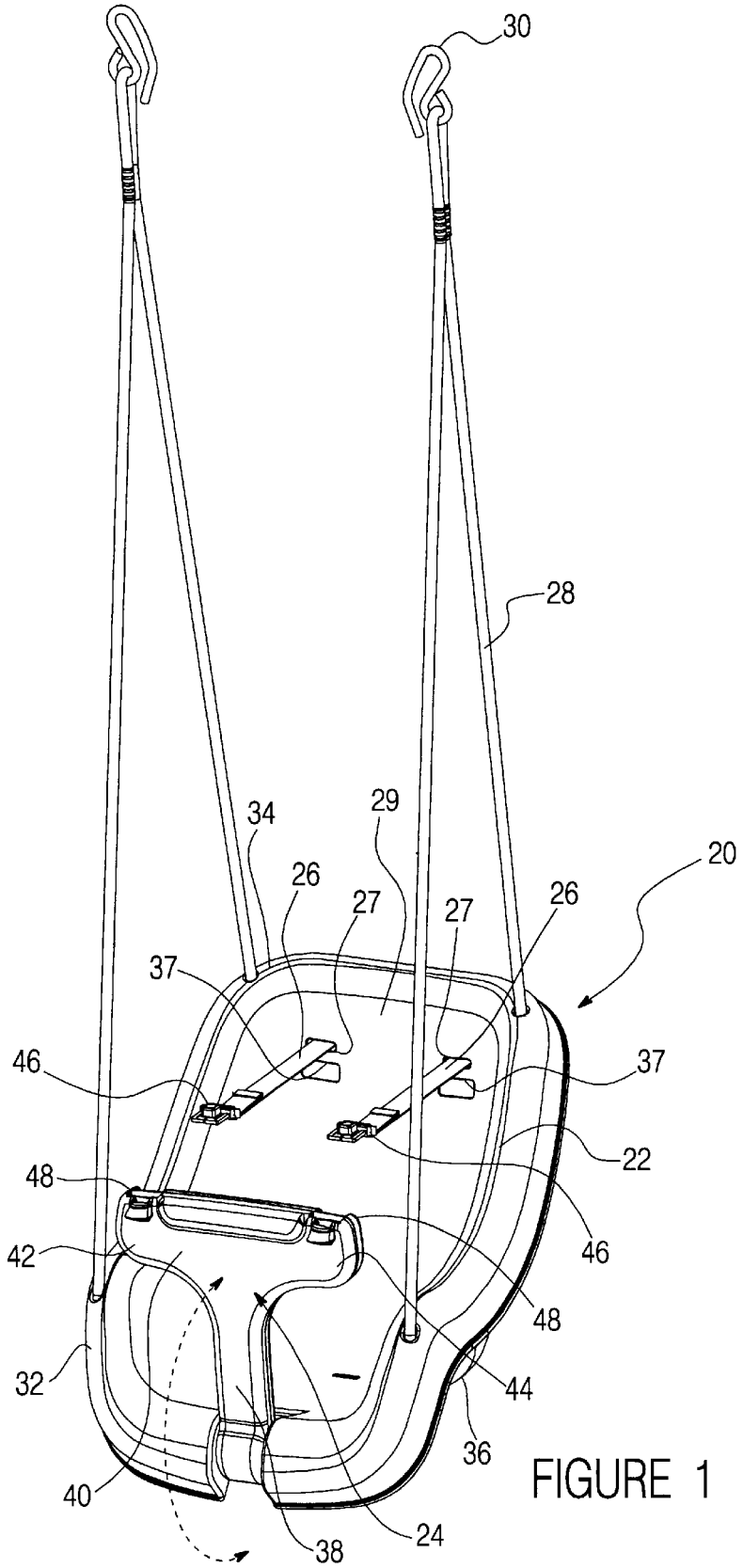
FIG. 1 is an isometric view of a swing seat constructed according to the present invention.

As shown in FIG. 1, a child's swing seat, shown generally at 20, includes a chair 22, and a T-bar 24 rotatably coupled thereto. The T-bar 24 includes a longitudinal portion 38 and a transverse portion 40 substantially perpendicular to the longitudinal portion 38. In one embodiment of the invention, the longitudinal and transverse portions 38 and 40 are formed as one piece with the width of the longitudinal portion 38 (measured in a direction across the front of the chair 22) substantially less than the width of the transverse portion 40.

Figure 2:
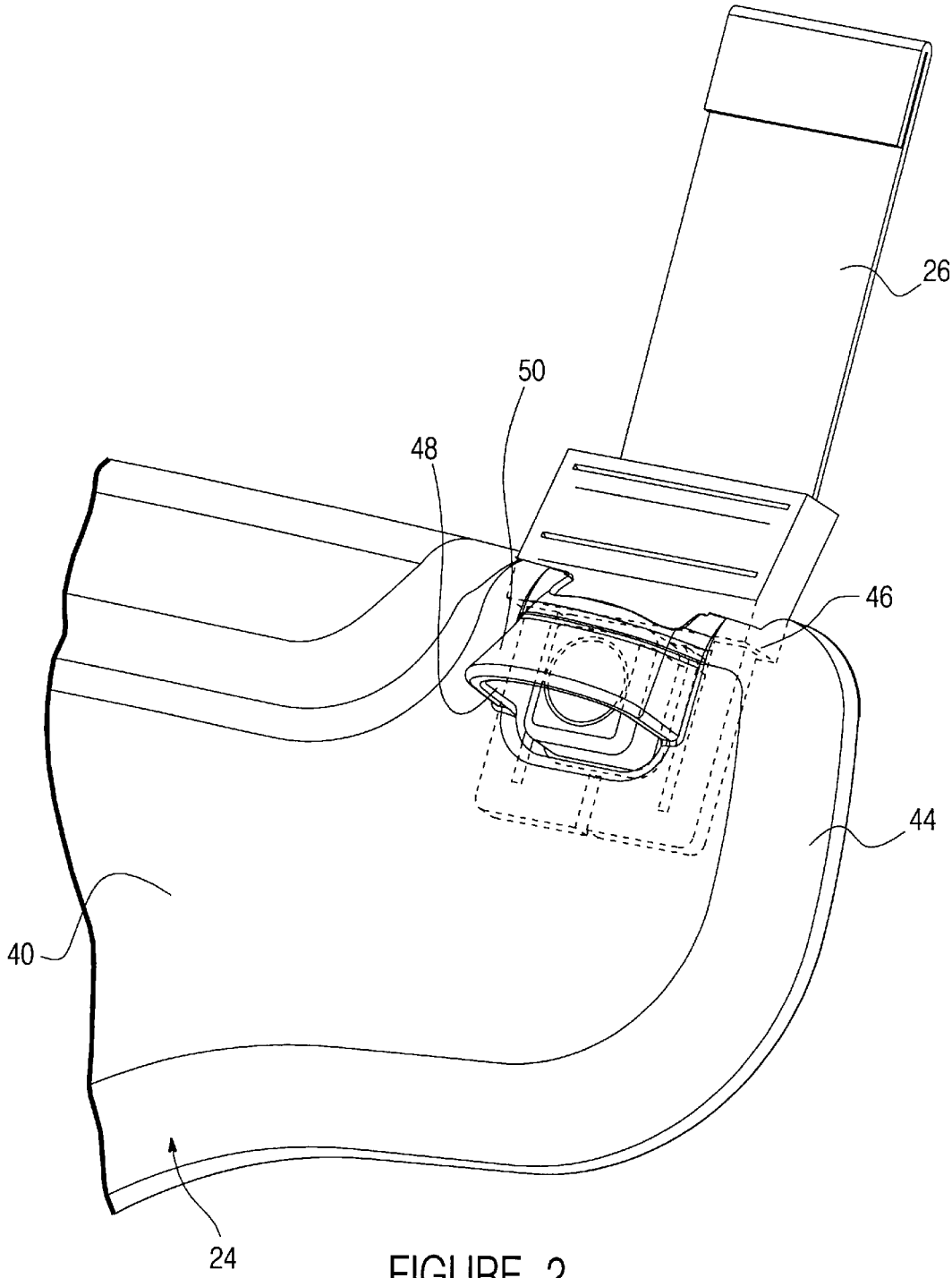
FIG. 2 is an isometric view of one of the straps and the T-bar when coupled to each other.

Also coupled to the chair 22 are a pair of straps 26 removeably engaging the transverse portion 40 of the T-bar 24. Each of the straps 26, in one embodiment of the invention, is threaded through upper holes 27 in the back portion 29 of the chair 22. On one end of each of the straps 26 is a buckle 46 for engaging the T-bar 24. The transverse portion 40 of the T-bar 24 includes right and left ends 42 and 44 respectively. As can be seen more clearly in FIG. 2, the slot 48 on the T-bar 24 is located directly underneath a collar 50. When a user desires to couple the strap 26 to the T-bar 24, the user simply slides the buckle 46 underneath the collar 50, locking the buckle 46 in place. Pressing down on the buckle 46 and pulling it away, in one embodiment of the invention, will cause it to disengage from the T-bar 24. The left and right ends 42 and 44 each include a slot 48 for receiving the buckle 46 of the strap 26. In other embodiments of the invention, fixing mechanisms other than buckles, such as Velcro®, hooks or other devices, may be used to secure the straps 26 to the T-bar 24. The collar 50 is also arranged such that it angled away from the child when he or she is positioned in the seat 20. The positioning of the child hinders the child from being capable of pressing down on the buckle 46 when the buckle 46 is underneath the collar. This arrangement helps to prevent the child from detaching the straps 26 from the T-bar 24.

Figure 3:
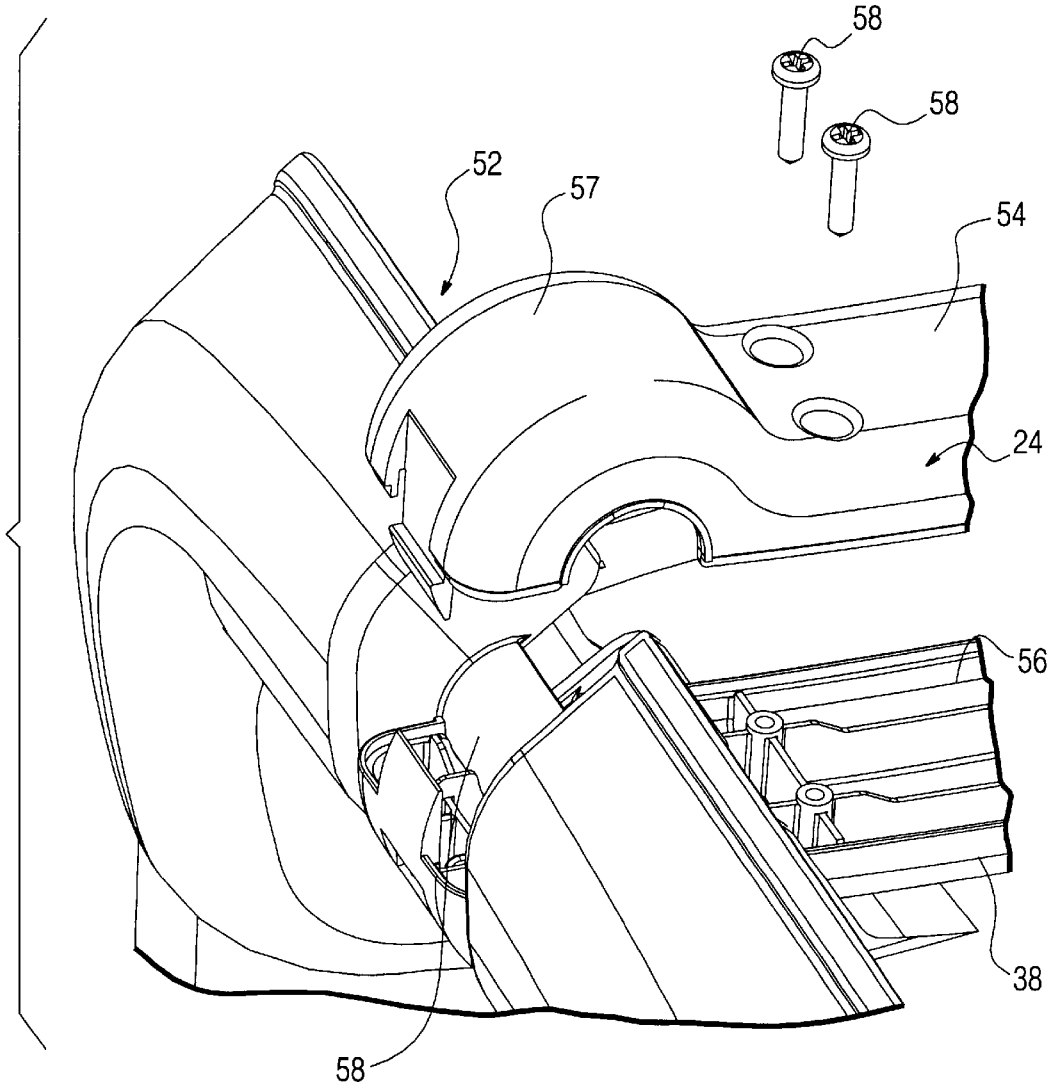
FIG. 3 is an exploded view of the portion of the T-bar that is coupled to the front portion of the seat

As shown in FIG. 1, the transverse portion 40 of the T-bar 24 is rotatably coupled to the front portion 32 of the chair 22. As further shown in FIG. 3, the T-bar 24 includes first and second portions 54 and 56 that are coupled to each other via screws 58. At the end of the longitudinal portion 38 is a circular member 57 which rotates around an inner bar 58. As can be seen in FIG. 1, the T-bar 24 is capable of being positioned so as to engage the straps 26, holding a child in the seat in a safe manner. Alternatively, the T-bar 24 can be rotated about an axis that is substantially parallel to the ground or other surface above which the swing seat 20 is suspended. The swing seat 20 is suspended above the ground by one or more ropes or cables 28 that are strung through the chair 22. Different types of materials can be used to suspend the swing seat 20. These materials can include rope, cable, chains or other materials. One or more hooks 30 are used to engage the cables 28 and suspend the swing seat 20 above the ground. These hooks 30 can be used to secure the swing seat 20 to a bar located above the ground (not shown) or to another object such as a tree.

Figure 4:
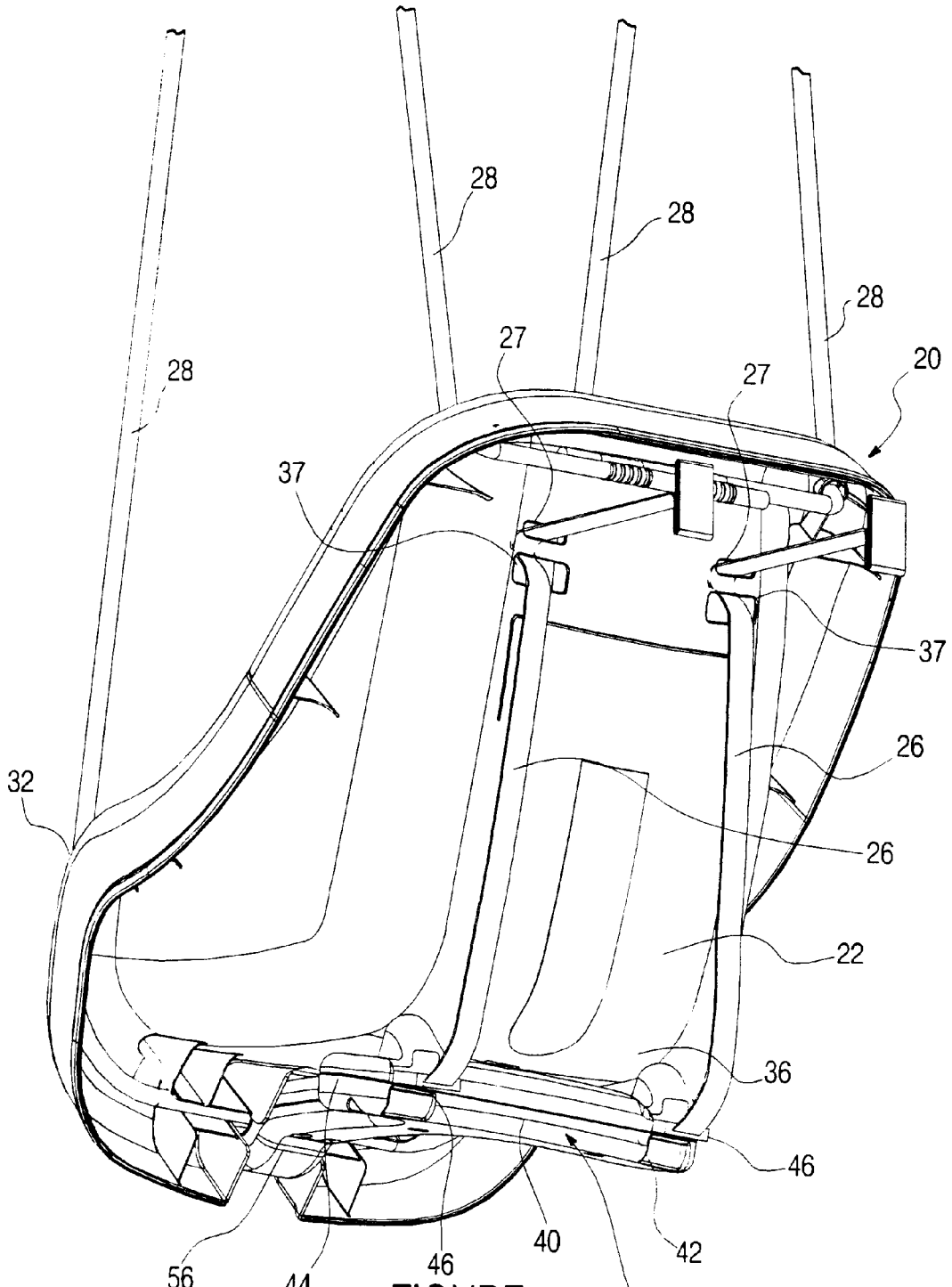
FIG. 4 is reverse isometric view of the swing seat of FIG. 1 showing the T-bar proximate to the bottom portion of the seat.
Figure 5:
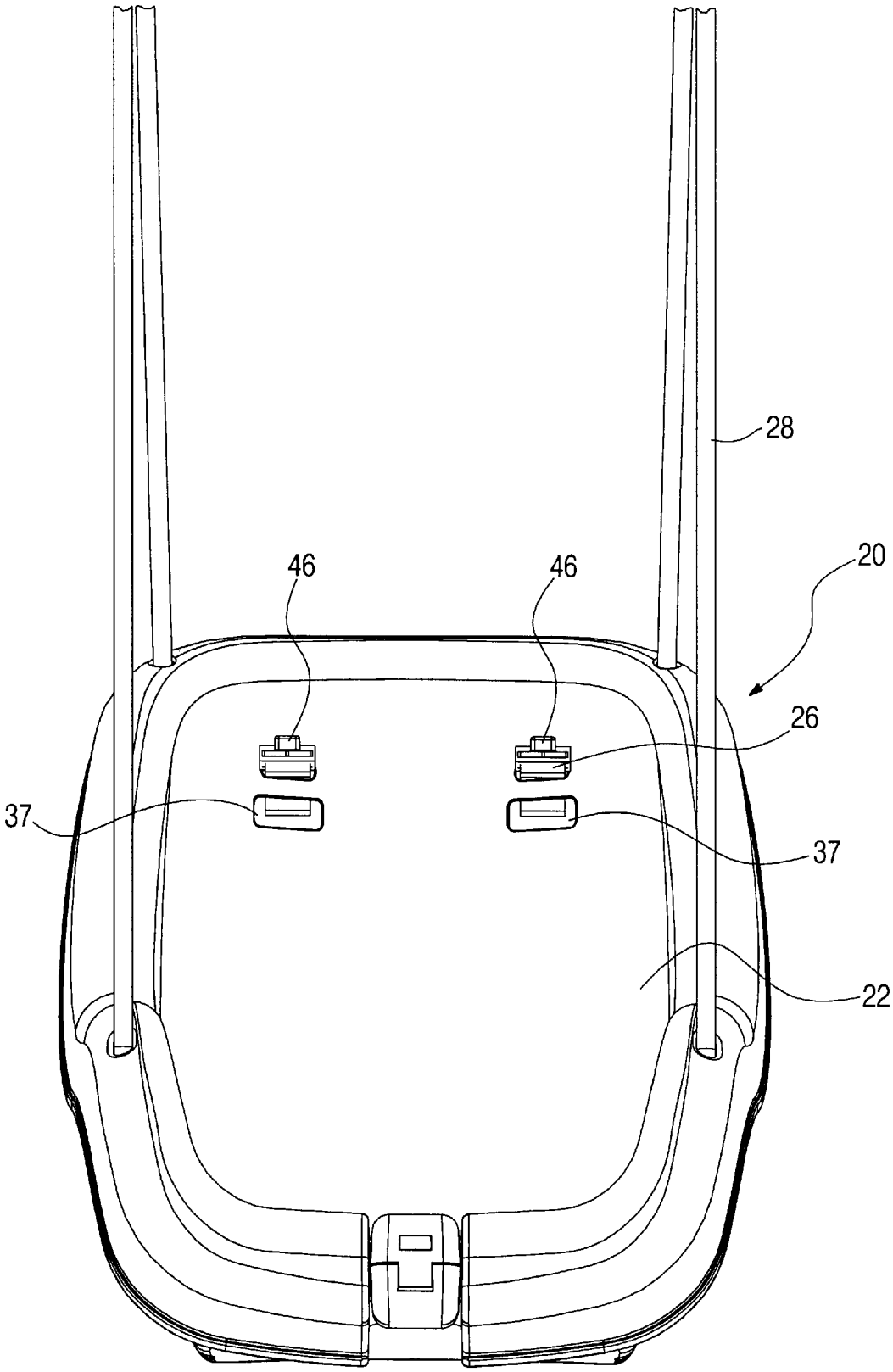
FIG. 5 is a front end view of the swing seat of FIG. 4.

As can be seen in FIGS. 4 and 5, the T-bar 24 is capable of rotating underneath the swing seat 20 and being fixed in a position proximate to the bottom portion 36 of the chair 22. When the T-bar 24 is proximate to the bottom portion 36 of the chair 22, the front portion 32 of the seat is sufficiently cleared to allow a person to either place a child in the swing seat 20 or to remove the child from the swing seat 20. As can be seen more clearly in FIG. 4, the transverse member 40 of the T-bar 24 is secured proximate the bottom portion 36 of the chair 22 by use of the same straps 26 that are used to secure the child in the chair 22. To secure the T-bar 24 below the chair 22, the straps 26 are threaded through lower holes 37 that are located below upper holes 27 on the back of the chair 22. The buckles 46 located at the end of the straps 26 are then used to connect the straps 26 to the left and right ends 42 and 44 of the T-bar 24. In one embodiment of the invention, the straps 26 can be lengthened or shortened by sliding the buckles 46 along the straps 26. In this embodiment, the straps 26 may need to be lengthened in order to reach the T-bar 24 when the T-bar 24 is located below the chair 22. To move the T-bar 24 away from the bottom portion 36 of the chair 22, the user simply removes the buckles 46 from the left and right ends 42 and 44 of the T-bar 24. The T-bar 24 is then capable of rotating.

While several preferred embodiments have been shown and described in this application, it is understood that changes and modifications can be made to the invention without departing from the invention's broader aspects. For example, it is possible to locate the straps in a variety of positions so as to engage the T-bar. Additionally, the T-bar does not necessarily have to have a T-shape but could instead have a variety of shapes while still serving the purpose of securing the child in the swing seat. Furthermore, a variety of methods can be used to suspend the swing seat above the ground and the entire swing seat can be part of a larger unit, such as a rocker, that is capable of swinging the chair without human assistance. It is also possible to secure the T-bar, when retracted, directly to the bottom portion of the chair by using a variety of fastening devices. Finally, it is also possible for a variety of securing devices, such as snaps, buttons or hooks, to be used to fasten the straps to the T-bar. Therefore, the present invention is not limited to the described and illustrated embodiments but only by the scope and sphere of the claims contained herein.

What is claimed is:

1. A swing seat, comprising:

a seat body having a front portion, a rear portion, an upper portion and a lower portion;

a support member hingedly coupled to the front portion of the seat body, wherein the support member is capable of rotating and engaging the lower portion of the seat body; and connecting members that couple the support member to the rear portion of the seat body in a use position and couple the support member to the lower portion of the seat body in a non-use position, whereby the connecting members provide support to a child's upper body when the connecting members couple the support member to the rear portion of the seat body.

2. The swing seat of claim 1, wherein the support member includes:

a longitudinal portion having a first end hingedly coupled to the seat body and a second end opposite the first end, and a transverse portion substantially perpendicular and coupled to the longitudinal portion.

3. The swing seat of claim 2, wherein the connecting members are removably coupled to the transverse portion of the support member.

4. The swing seat of claim 3, wherein the support member, when attached to the connecting members, is substantially prevented from rotating relative to the seat body.

5. The swing seat of claim 4, wherein the connecting members are coupled to substantially opposite ends of the transverse portion of the support member.

6. The swing seat of claim 5, further comprising means for suspending the seat above the ground.

7. A swing seat comprising:

a chair including a region for the placement of a person;

a bar rotatably coupled to the chair at one end thereof and capable of engaging a lower rear portion of the chair at the substantially opposite end thereof;

a plurality of straps removably coupled to the bar, wherein the plurality of straps each include a buckle at one end thereof for mateably engaging slots on the transverse member of the bar; and at least one support rope coupled to the seat, the support rope suspending the seat above a surface, wherein the bar includes a plurality of collars positioned above the slots, the buckles being positioned below the collars when the buckles engage the slots.

8. The swing seat of claim 7, wherein the bar includes a longitudinal member and a transverse member substantially perpendicular to the longitudinal member at one end thereof, wherein the end of the longitudinal member opposite the transverse member is rotatably coupled to the chair.

9. The swing seat of claim 8, wherein the longitudinal member is formed as one piece with the transverse member.

10. The swing seat of claim 8, wherein the straps are removably coupled to the transverse member of the bar.

11. The swing seat of claim 10, wherein the straps are removably coupled to substantially opposite ends of the bar.

12. A swing seat comprising, a chair having an upper portion, a lower portion, a front portion and a rear portion;

at least one rope for suspending the chair above a surface, a bar rotatably coupled at a first end to the front portion of the chair, a second end of the bar capable of engaging a lower rear portion of the chair, wherein the bar has a nonuniform width, the width of the first end being substantially smaller than the width of the second end;

a pair of straps for coupling the second end of the bar to the chair, wherein the straps are removably coupled to substantially opposite portions of the second end of the bar such that the bar, when coupled to the straps, is substantially prevented from rotating relative to the chair;

a plurality of slots at the substantially opposite portions of the second end of the bar, the slots capable of receiving the straps for engagement with the bar; and a plurality of collars located above the slots, wherein the straps, when engaging the bar, are positioned substantially below the collars.

* * * * *